US006261105B1

(12) United States Patent
Uezono

(10) Patent No.: US 6,261,105 B1
(45) Date of Patent: Jul. 17, 2001

(54) ELECTRIC CONNECTION BOX

(75) Inventor: Kouichi Uezono, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/437,231

(22) Filed: Nov. 10, 1999

(30) Foreign Application Priority Data

Dec. 4, 1998 (JP) ..... 10-345978

(51) Int. Cl.[7] ..... H01R 12/00
(52) U.S. Cl. ..... 439/76.2; 439/76.1
(58) Field of Search ..... 439/76.2, 76.1, 439/949; 174/52.1, 138 F, 50, 50.6, 53, 54, 59

(56) References Cited

U.S. PATENT DOCUMENTS 4,408,823 10/1983 Huber ..... 339/208
5,285,011 * 2/1994 Shimochi ..... 174/52.1

FOREIGN PATENT DOCUMENTS 1-69314 5/1989 (JP) ..... H02G/3/16
4-43329 4/1992 (JP) ..... H02G/3/16
8-37717 2/1996 (JP) ..... H02G/3/16

* cited by examiner

*Primary Examiner*—Gary Paumen
*Assistant Examiner*—Ross Gushi
(74) *Attorney, Agent, or Firm*—Sughrue, Mion, Zinn, Macpeak & Seas, PLLC

(57) ABSTRACT

An electric connection box 10 comprises a connection box body 11, which includes a plurality of projecting tab terminal portions 13*a* connected respectively to one ends 31 of relay terminals 30, and a support seat 20 on which the one ends 31 of the relay terminals 30 are seated in such a manner that the tab terminal portions 13*a* pass through the support seat, and a cover 40 which includes terminal insertion ports 42 opposed respectively to the tab terminal portions 13*a*, and terminal receiving portions for respectively receiving the relay terminals 30. The cover covers the relay terminals 30 and the connection box body 11, and terminal portions 52 of an electric part 50 are adapted to be inserted respectively into the terminal insertion ports 42. The terminal portions 52 of the electric part 50 are passed respectively through the terminal insertion ports 42 in the cover 40, and are connected respectively to the other ends 32 of the relay terminals 30. The connection box body 11 and the support seat 20 are formed separately from each other.

1 Claim, 5 Drawing Sheets

ELECTRIC CONNECTION BOX

BACKGROUND OF INVENTION

1. Field of Invention

This invention relates to an electric connection box in which tab terminal portions of bus bars, forming a branch circuit, are connected to male terminal portions of a relay through female-female-type relay terminals.

2. Related Art

FIGS. 7 to 10 show a conventional electric connection box of the type described. As shown in FIGS. 7 and 9, in this electric connection box 1, a convex support seat 3 is formed integrally on a bus bar-mounting board 2 forming part of a connection box body. Cross-shaped partition ribs 3*b* are integrally formed on and project from an upper surface 3*a* of the support seat 3, and a plurality of tab terminal portions 4*a* of bus bars 4 project outwardly from the upper surface 3*a*, partitioned by the ribs 3*b*, in an exposed manner. A lower end 5*a* of a female-female-type relay terminal 5 is connected to each tab terminal portion 4*a*. The bus bar-mounting board 2 and the plurality of relay terminals 5 are covered with an upper cover 6.

As shown in FIGS. 7 and 10, a box-like relay block 7 is integrally formed on and projects from that portion of the upper cover 6 to be opposed to the support seat 3 on the bus bar-mounting board 2. A plurality of terminal insertion ports 7*b* of a rectangular shape are formed through a top plate portion 7*a* of the relay block 7, and a plurality of male terminal portions 9, projecting into the interior of a hood portion 8*a* of a flasher relay 8, are adapted to be inserted into the terminal insertion ports 7*b*, respectively. When the hood portion 8*a* of the flasher relay 8 is fitted on the relay block 7 of the upper cover 6, the male terminal portions 9 of the flasher relay 8 pass respectively through the terminal insertion ports 7*b* in the relay block 7, and are connected respectively to upper ends 5*b* of the relay terminals 5.

Japanese Utility Model Unexamined Publication Hei. 1-69314 discloses a technique analogous to the electric connection box 1 in which the support seat 3 is integrally formed on and projects from the bus bar-mounting board 2.

In the above conventional electric connection box 1, however, the support seat 3 for seating the plurality of relay terminals 5 thereon is integrally formed on and projects from the bus bar-mounting board 2, and therefore the upper cover 6 must be mounted to cover the relay terminals 5 after the relay terminals 5 are connected respectively to the tab terminal portions 4*a* projecting from the upper surface of the support seat 3 on the bus bar-mounting board 2. And besides, tilt prevention ribs can not be formed at opposite side portions of the upper surface 3*a* of the support seat 3, and therefore those relay terminals 5, disposed at the opposite side portions, are tilted, so that the upper cover 6 can not be easily mounted on the bus bar-mounting board.

Furthermore, during the time when the upper cover 6 is mounted to cover the relay terminals 5, the relay block 7 of the upper cover 6 can be scraped by the upper edges of the relay terminals 5, and also the relay block 7 can strike against the relay terminals 5 to deform the same, and if the upper cover 6 is mounted to cover such deformed relay terminals 5, there is a possibility that a disadvantage, such as an incomplete electrical connection, is encountered.

FIG. 11 shows another conventional construction in which L-shaped tab terminal portions 4*a* of bus bars 4 project from an upper surface 3*a* of a support seat 3', and in this case the upper surface 3*a* can not serve as a sufficient seat surface for the relay terminals 5, and therefore it has been difficult to properly seat the relay terminals 5 on this seat surface.

SUMMARY OF INVENTION

This invention has been made in order to solve the above problems, and an object of the invention is to provide an electric connection box in which an electric part can be mounted thereon easily and positively, and besides a stable electrical connection can be secured.

According to the present invention, there is provided an electric connection box comprising a connection box body, which includes a plurality of projecting tab terminal portions connected respectively to one ends of relay terminals, and a support seat on which the one ends of the relay terminals are seated in such a manner that the tab terminal portions pass through the support seat; and a cover which includes terminal insertion ports opposed respectively to the tab terminal portions, and terminal receiving portions for respectively receiving the relay terminals, the cover covering the relay terminals and the connection box body, and terminal portions of an electric part being adapted to be inserted respectively into the terminal insertion ports; wherein the terminal portions of the electric part are passed respectively through the terminal insertion ports in the cover, and are connected respectively to the other ends of the relay terminals; provided in that the connection box body and the support seat are formed separately from each other.

In this electric connection box, the connection box body, having the plurality of projecting tab terminal portions, and the support seat, on which the relay terminals are seated, are formed separately from each other. Therefore, the electric part can be easily and positively mounted on the electric connection box, and the stable electrical connection can be obtained. And besides, after the relay terminals are received respectively in the terminal receiving portions of the cover, the support seat can be mounted, and therefore the assembling operation of the electric connection box is easy.

In the electric connection box of the present invention, the support seat has terminal-passing portions through which the tab terminal portions pass, respectively, and those surfaces of the support seat, from which the tab terminal portions, passing through the support seat, project outwardly, respectively, serve as seat surfaces on which the one ends of the relay terminals are seated, respectively.

In this electric connection box, the support seat can be easily mounted on the tab terminal portions through the terminal-passing portions formed at the support seat. And besides, the sufficient seat surfaces of the support seat are secured, and the one ends of the relay terminals are positively seated on these seat surfaces, respectively.

DETAILED DESCRIPTION OF PREFERRED EMBODIMENTS

One preferred embodiment of the present invention will now be described with reference to the drawings.

Figure 1:
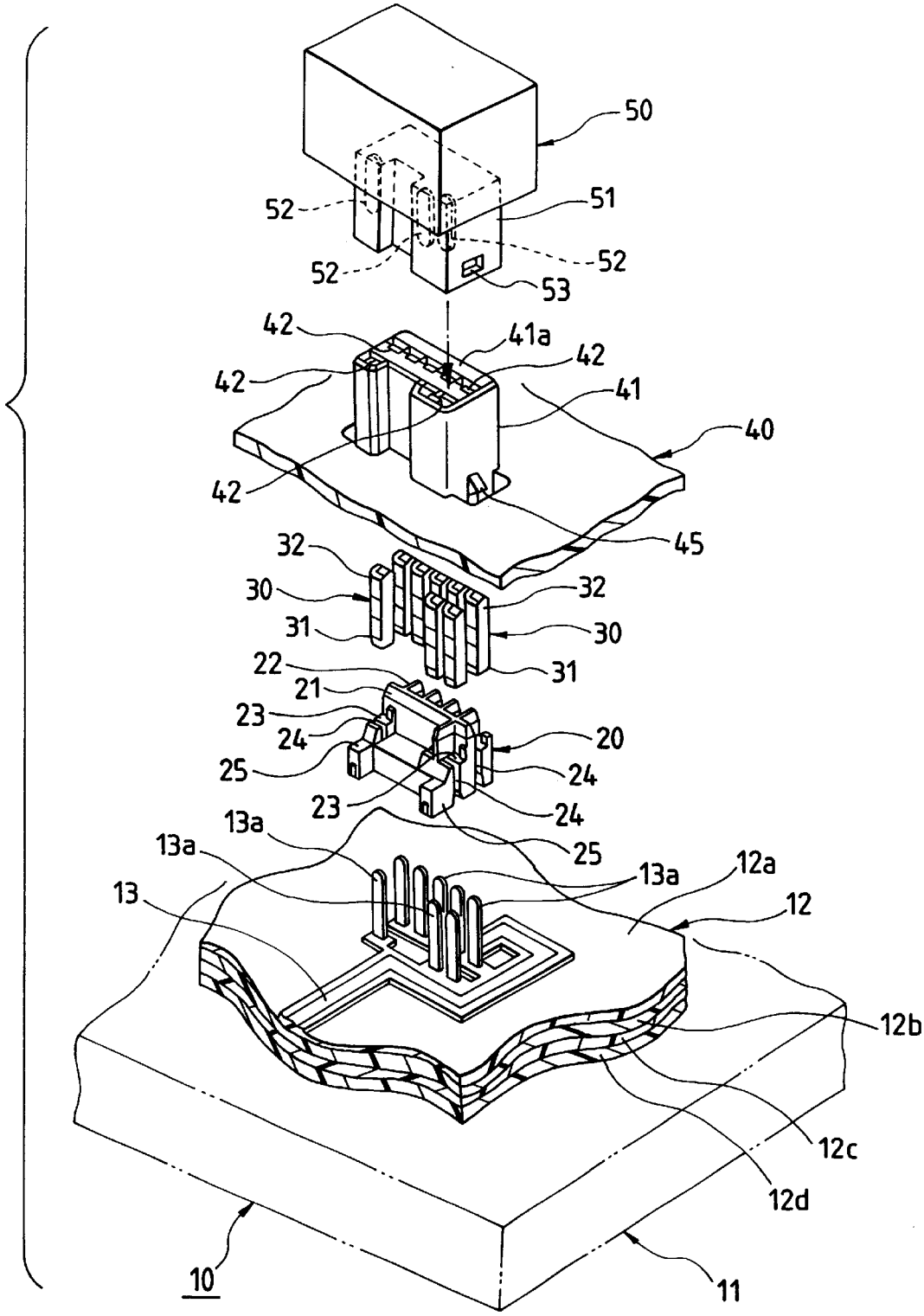
FIG. 1 is an exploded, perspective view showing an important portion of one preferred embodiment of an electric connection box of the present invention.
Figure 2:
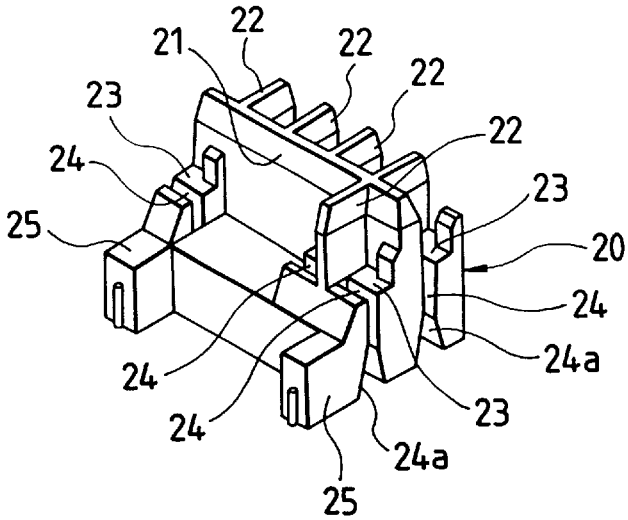
FIG. 2 is a perspective view of a support seat used in the electric connection box.
Figure 3:
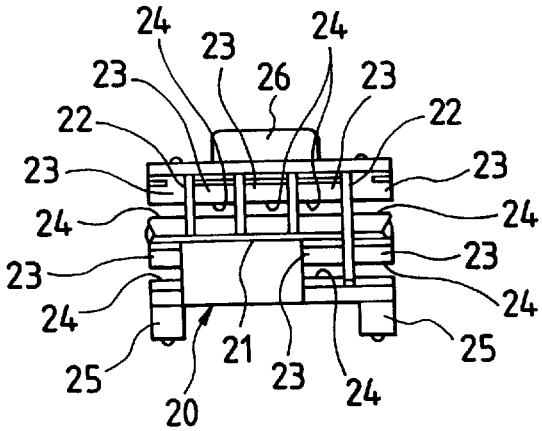
FIG. 3 is a plan view of the support seat.
Figure 4:
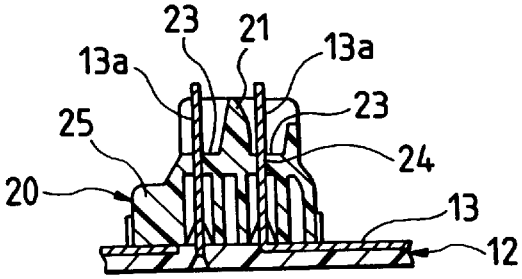
FIG. 4 is a cross-sectional view showing the relation between the support seat and tab terminal portions of bus bars.
Figure 5:
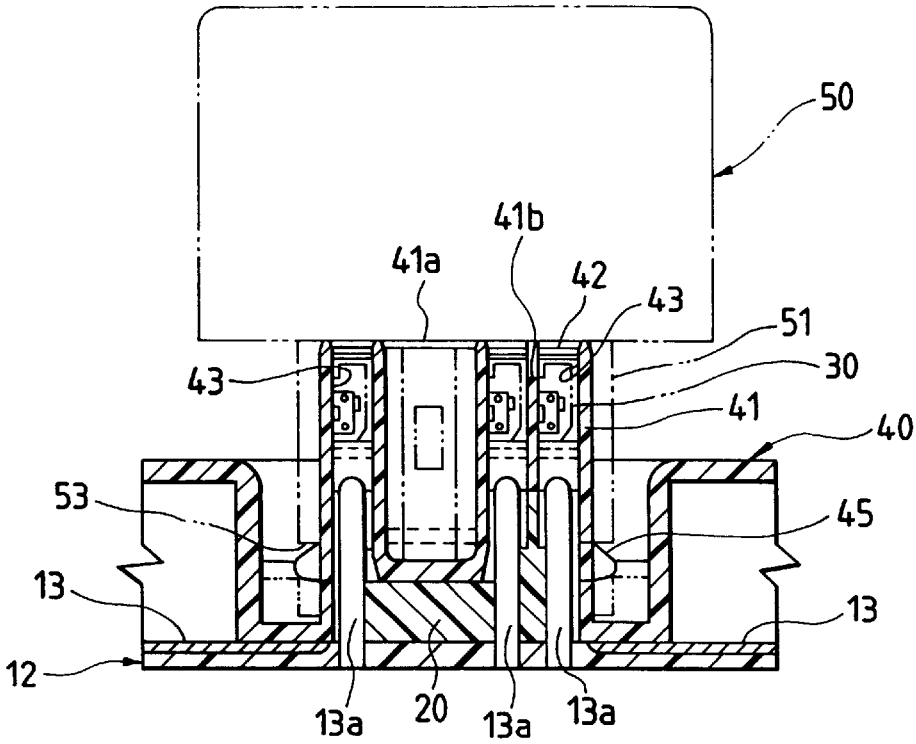
FIG. 5 is a cross-sectional views showing an important portion of the electric connection box.
Figure 6:
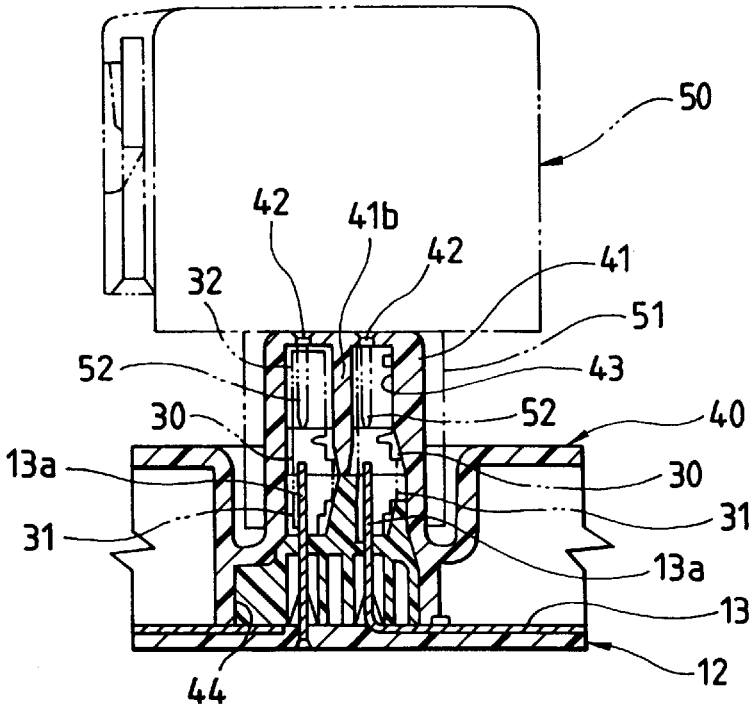
FIG. 6 is a cross-sectional views showing an important portion of the electric connection box.
Figure 7:
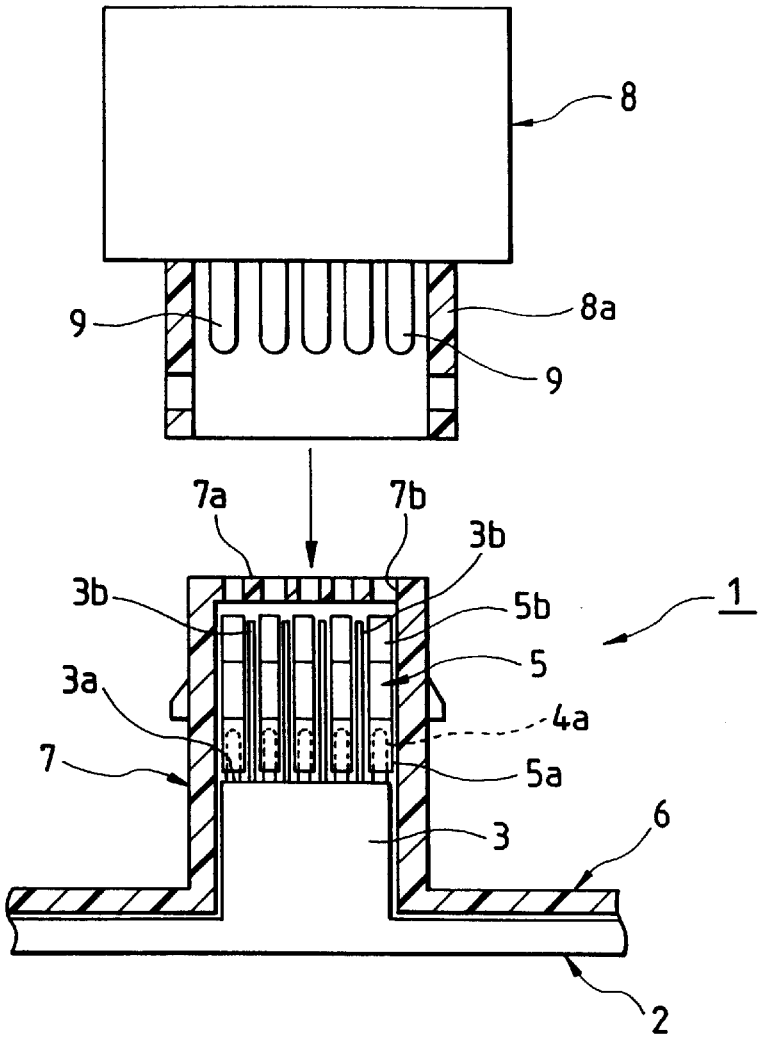
FIG. 7 PRIOR ART
FIG. 7 is a cross-sectional view showing an important portion of a conventional electric connection box.
Figure 8:
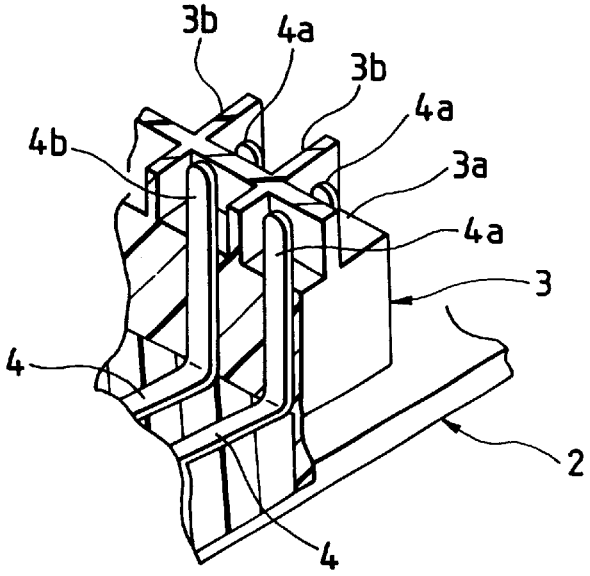
FIG. 8 PRIOR ART
FIG. 8 is a perspective view showing a support seat of the conventional electric connection box.
Figure 9:
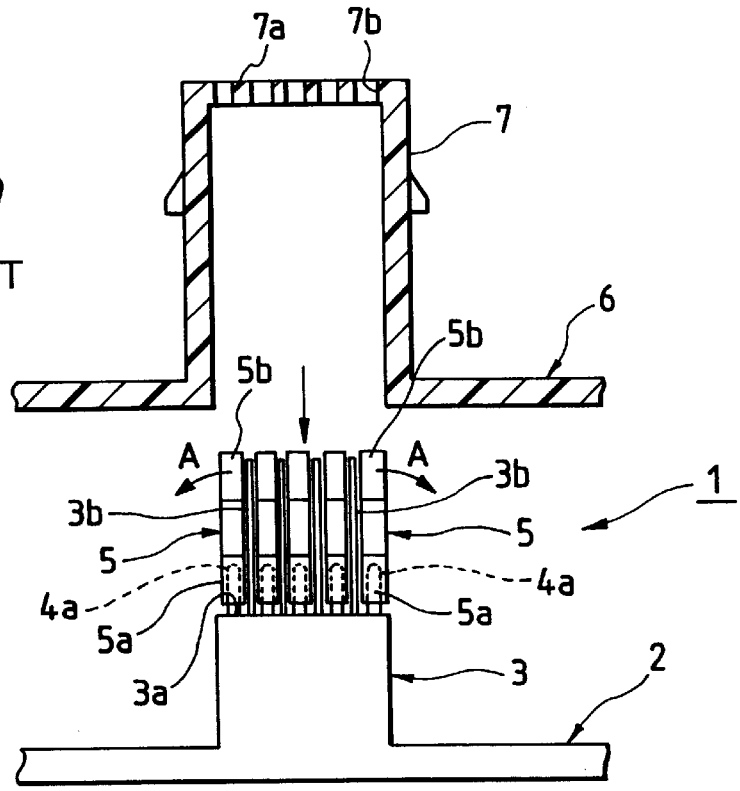
FIG. 9 PRIOR ART
FIG. 9 is a partly cross-sectional view of the conventional electric connection box, showing a condition before a cover is attached to a connection box body.
Figure 10:
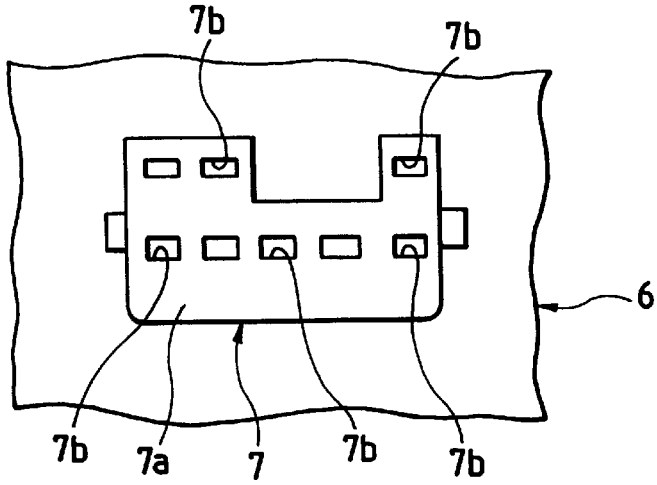
FIG. 10 PRIOR ART
FIG. 10 is a plan view showing an important portion of the cover of the above conventional construction.
Figure 11:
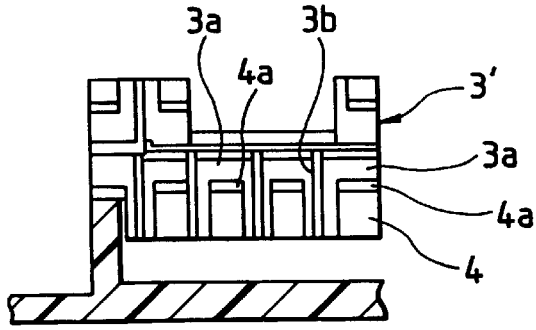
FIG. 11 PRIOR ART
FIG. 11 is a view showing a support seat of another conventional electric connection box.

FIG. 1 is an exploded, perspective view showing an important portion of one preferred embodiment of an electric connection box of the present invention, FIG. 2 is a perspective view of a support seat used in this electric connection box, FIG. 3 is a plan view of the support seat, FIG. 4 is a cross-sectional view showing the relation between the support seat and tab terminal portions of bus bars, and FIGS. 5 and 6 are cross-sectional views showing important portions of the electric connection box.

As shown in FIGS. 1, 5 and 6, the electric connection box 10 comprises a generally-rectangular connection box body 11 of a synthetic resin, which includes a bus bar-mounting board 12 having tab terminal portions 13*a* of a plurality of bus bars 13 projecting therefrom, the block-like support seat 20 of a synthetic resin mounted on the tab terminal portions 13*a* in such a manner that the tab terminal portions 13*a* extend through the support seat 20, with distal ends thereof exposed to the exterior, a plurality of female-female-type relay terminals 30 which are seated at their lower (one) ends 31 respectively on a plurality of seat surfaces 23 which are defined by an upper surface (side) of the support seat 20, and are separated from one another by ribs 21 and 22 integrally formed on and projecting from this upper surface, and a generally-box-shaped upper cover 40 of a synthetic resin for covering the relay terminals 30, the support seat 20, and the connection box body 11. A relay block 41 is integrally formed on and projects from a predetermined portion of the upper cover 40, and a hood portion 51 of a flasher relay (electric part) 50 is adapted to be fitted on this relay block 41.

As shown in FIG. 1, the bus bar-mounting board 12 includes a plurality of insulating boards 12*a* to 12*d* laminated together, and the tab terminal portions 13*a* project from the uppermost insulating board 12*a*. As shown in FIG. 6, distal ends of the tab terminal portions 13*a* are adapted to be connected to the lower ends 31 of the relay terminals 30, respectively.

The tab terminal portions 13*a* extend through the support seat 20, and the lower ends 31 of the relay terminals 30 are seated on the support seat 20. This support seat 20 is separate from the bus bar-mounting board 12 forming part of the connection box body 11. The rib 21 and the plurality of ribs 22 are integrally formed on and project from the upper surface of the support seat 20, and the rib 21 extends in a lengthwise direction while the ribs 22 extend in a widthwise direction. Upper surfaces of convex portions, separated from one another by the ribs 21 and 22, serve respectively as the seat surfaces 23 for respectively seating the lower ends 31 of the relay terminals 30 thereon. As shown in FIGS. 2 to 4, a terminal-passing portion 24 (of a slit-like or a hole-like shape) for passing the tab terminal portion 13*a* therethrough is formed in a central portion of each of the seat surface 23. Opposed surfaces of a lower end of each terminal-passing portion 24 are defined by tapering surfaces 24*a*, respectively. Convex portions 25 are formed integrally respectively on opposite side portions of a front surface of the support seat 20, and a convex portion 26 is formed integrally on a central portion of a rear surface of the support seat 20, and these convex portions 25 and 26 are adapted to be received respectively in recessed portions 44 (described later) in the upper cover 40.

As shown in FIG. 1, the box-like relay block 41 (having a generally U-shape when viewed from the upper side) is integrally formed on and projects from that portion of the upper cover 40 to be opposed to the tab terminal portions 13*a* of the bus bar-mounting board 12. A plurality of terminal insertion ports 42 of a rectangular shape are formed through a top plate portion 41*a* of the relay block 41, and a plurality of male terminal portions 52, projecting into the interior of the hood portion 51 of the flasher relay 50, are adapted to be inserted into the terminal insertion ports 42, respectively. Generally-cross-shaped ribs 41*b* are integrally formed on and extend downwardly from the top plate portion 41*a*, and spaces, separated from one another by these ribs 41*b*, serve respectively as terminal receiving chambers 43 for respectively receiving the relay terminals 30. The recesses portions 44 of a generally square cross-section for positioning and receiving the support seat 20 are formed below the terminal receiving chambers 43 in the relay block 41.

The male terminal portions 52 of the flasher relay 50 are inserted respectively into the terminal insertion ports 42 in the relay block 41 of the upper cover 40, and are connected to upper (other) ends 32 of the relay terminals 30, respectively. Retaining claws (retaining portions) 45 of a triangular cross-section are integrally formed on and project from central portions of lower portions of the opposite sides of the relay block 41, respectively. Engagement holes (engagement portions) 53 are formed respectively in those portions of the hood portion 51 of the flasher relay 50 to be opposed respectively to the retaining claws 45, and the retaining claws 45 can be releasably engaged in the engagement holes 53, respectively.

In the electric connection box 10 of the above embodiment, the bus bar-mounting board 12 (which has the plurality of tab terminal portions 13*a* projecting therefrom, and forms part of the connection box body 11) and the support seat 20 (for seating the plurality of relay terminals 30 thereon) are formed separately from each other, and the support seat 20, separate from the bus bar-mounting board 12, is fitted on the tab terminal portions 13*a* on the bus bar-mounting board 12. Therefore, the bus bar-mounting board 12 can be formed into a standard configuration, and also the seat surfaces 23 for the relay terminals 30 can be secured. Therefore, the flasher relay 50 can be easily and positively mounted on the electric connection box 10, and the stable electrical connection can be secured.

After the relay terminals 30 are received respectively in the terminal receiving chambers 43 in the relay block 41 of the upper cover 40, the support seat 20 can be fitted on the tab terminal portions 13 on the bus bar-mounting board 12, and therefore the efficiency of the operation for mounting the upper cover 40 on the connection box body 11 is enhanced, so that the electric connection box 10 can be produced easily. At this time, the relay terminals 30 can be positively inserted respectively into the terminal receiving chambers

43 in the relay block 41, and therefore the scraping of the upper cover 40 by the relay terminals 30 and the deformation of the relay terminals 30, as experienced in the conventional construction, will not occur, and therefore the stable electrical connection can be secured.

The plurality of terminal-passing portions 24 (of a slit-like or a hole-like shape) for respectively passing the tab terminal portions 13*a* therethrough are formed in the support seat 20, and those surfaces of the support seat 20, from which the tab terminal portions 13*a*, passing through the support seat 20, project outwardly, respectively, serve as the seat surfaces 23 on which the lower ends 31 of the relay terminals 30 are seated, respectively. Therefore, the support seat 20 can be easily and positively mounted on the tab terminal portions 13*a*, and also the sufficient seat surfaces 23 can be secured on the support seat 20 so that the lower ends 31 of the relay terminals 30 can be positively seated on these seat surfaces, respectively.

In the above embodiment, although the flasher relay is used as an electric part, any other suitable electric part, such as a fuse, can be used. The relay terminals are not limited to the female-female-type, and may be of the female-male-type.

As described above, in the present invention, the connection box body, having the plurality of projecting tab terminal portions, and the support seat, on which the relay terminals are seated, are formed separately from each other. Therefore, the electric part can be easily and positively mounted on the electric connection box, and the stable electrical connection can be obtained. And besides, after the relay terminals are received respectively in the terminal receiving portions of the cover, the support seat can be mounted, and therefore the efficiency of the assembling operation for the electric connection box is easy.

In the present invention, the support seat has the terminal-passing portions through which the tab terminal portions pass, respectively, and those surfaces of the support seat, from which the tab terminal portions, passing through the support seat, project outwardly, respectively, serve as the seat surfaces on which the one ends of the relay terminals are seated, respectively. Therefore, the support seat can be easily mounted on the tab terminal portions, and besides, the sufficient seat surfaces of the support seat can be secured, and the one ends of the relay terminals can be positively seated on these seat surfaces, respectively.

What is claimed is:

1. An electric connection box comprising:

a connection box body including:

a plurality of projecting tab terminal portions connected respectively to one ends of relay terminals;

a support seat on which the one ends of said relay terminals are seated in such a manner that said tab terminal portions pass through said support seat;

a cover including:

terminal insertion ports opposed respectively to said tab terminal portions;

terminal receiving portions for respectively receiving said relay terminals, said cover covering said relay terminals and said connection box body, and terminal portions of an electric part being adapted to be inserted respectively into said terminal insertion ports, wherein said terminal portions of said electric part are passed respectively through said terminal insertion ports in said cover, and are connected respectively to the other ends of said relay terminals, and said connection box body and said support seat are formed separately form each other, wherein said support seat has seat surfaces on which the one ends of said relay terminals are seated, and said support seat has terminal-passing portions formed below and through the central portion of each of said seat surfaces for receiving said tab terminal portions so that said tab terminal portions project upwardly from said seat surfaces for engaging with the one ends of said relay terminals, and wherein tapering surfaces are formed at the lower ends of each of said terminal-passing portions for facilitating insertion of said tab terminal portions, and ribs are formed on the upper portion of said support seat for separating said seat surfaces from each other; and convex portions formed on opposite side portions of a front surface of said support seat and on a central portion of a rear surface of said support seat, said convex portions adapted to be received in recessed portions of said cover for facilitating engagement of said cover with said support seat.

* * * * *